US012410684B2

(12) United States Patent
Witka et al.

(10) Patent No.: US 12,410,684 B2
(45) Date of Patent: Sep. 9, 2025

(54) SUBSEA SYSTEM COMPRISING A PRECONDITIONING UNIT AND PRESSURE BOOSTING DEVICE AND METHOD OF OPERATING THE PRECONDITIONING UNIT

(71) Applicant: FMC Technologies Do Brasil LTDA, Rio de Janeiro (BR)

(72) Inventors: Anderson Witka, Rio de Janeiro (BR); Diogo Lauria De Faria, Rio de Janeiro (BR); Hermes Machado, Rio de Janeiro (BR); Vivian Gullo Salgado, Rio de Janeiro (BR); Mattias Rudh, Asker (NO)

( * ) Notice: Subject to any disclaimer, the term of this patent is extended or adjusted under 35 U.S.C. 154(b) by 0 days.

(21) Appl. No.: 18/024,243

(22) PCT Filed: Sep. 2, 2020

(86) PCT No.: PCT/IB2020/058152

§ 371 (c)(1),
(2) Date: Mar. 1, 2023

(87) PCT Pub. No.: WO2022/049407

PCT Pub. Date: Mar. 10, 2022

(65) Prior Publication Data

US 2023/0287763 A1 Sep. 14, 2023

(51) Int. Cl.
*E21B 36/00* (2006.01)
*E21B 41/00* (2006.01)
(Continued)

(52) U.S. Cl.
CPC ..... *E21B 36/001* (2013.01); *E21B 41/0007* (2013.01); *E21B 43/01* (2013.01); *E21B 43/12* (2013.01)

(58) Field of Classification Search
CPC .... E21B 36/001; E21B 41/0007; E21B 43/01; E21B 43/12
(Continued)

(56) References Cited

U.S. PATENT DOCUMENTS

2009/0189617 A1* 7/2009 Burns ..... E21B 43/24 324/649
2017/0167809 A1* 6/2017 Becquin ..... E21B 43/121
(Continued)

FOREIGN PATENT DOCUMENTS

GB 2503927 A 1/2014
WO WO 2013/174584 A1 11/2013
(Continued)

*Primary Examiner* — Tara Schimpf
*Assistant Examiner* — Patrick F Lambe

(57) ABSTRACT

A subsea system (1) connected to a subsea well (4) for boosting a process fluid flowing out of the well, comprising: —a preconditioning arrangement (2) connectable to a process fluid line from a well, wherein the preconditioning arrangement comprises at least one sensor for measuring temperature and one sensor for measuring pressure of the process fluid—means for estimating density of the process fluid based on measured temperature and pressure, —a cooler system (20, 21) comprising at least a first cooler for cooling the process fluid wherein the subsea system further comprises: —a pressure boosting device (3) arranged downstream of the preconditioning arrangement (2), the pressure boosting device having an operational window dictating operational parameter in terms of maximum and minimum allowable density of the process fluid entering the pressure boosting device (3).

18 Claims, 6 Drawing Sheets

(51) Int. Cl.
*E21B 43/01* (2006.01)
*E21B 43/12* (2006.01)

(58) Field of Classification Search
USPC ..... 166/335
See application file for complete search history.

(56) References Cited

U.S. PATENT DOCUMENTS

| | | | | |
|---|---|---|---|---|
| 2018/0002623 | A1* | 1/2018 | Noekleby | B01D 63/046 |
| 2018/0106131 | A1* | 4/2018 | Kanstad | E21B 41/0007 |
| 2021/0253449 | A1* | 8/2021 | Katz | C02F 1/441 |

FOREIGN PATENT DOCUMENTS

| | | | |
|---|---|---|---|
| WO | WO 2014/003575 | A1 | 1/2014 |
| WO | WO 2014/049024 | A2 | 4/2014 |

* cited by examiner

SUBSEA SYSTEM COMPRISING A PRECONDITIONING UNIT AND PRESSURE BOOSTING DEVICE AND METHOD OF OPERATING THE PRECONDITIONING UNIT

FIELD OF THE INVENTION

The present invention relates to the field of subsea systems, and in particular to subsea systems comprising a preconditioning unit upstream of a pressure boosting device.

BACKGROUND OF THE INVENTION

As new oil and gas production wells are discovered and the old ones lower their production curve, or there is an increase in the production of other fluids (such as water or gas), different from oil, new challenges are faced in order to continue producing with high efficiency. Various technologies are under research and can be applied for the improvement of productivity. One of the applied technologies is the monophasic or multiphasic fluid pressure elevation system.

These systems elevate the pressure of the fluids so that they can be transported to an oil rig, to an onshore location or to offshore production and/or processing units. Another application is to elevate the pressure through the utilization of subsea systems, and subsequently re-injecting them.

With the use of these pressure elevation systems, challenges arise regarding the different types of fluids that can be used in these systems and the high pressure increases that they can be subjected to. One consequence of the increase in fluid pressure is the increase in temperature.

This increase in temperature in the fluid is proportional to the increase in pressure. Thus, the greater the pressure gain of the system, the greater its increase in temperature.

Due to these characteristics, the demand for subsea heat exchangers such as coolers may be required in these pressure elevation systems.

The subsea cooling system for hydrocarbons is an increasingly current demand for various applications in fluid conditioning in order to: meet flexible duct requirements, improve the efficiency of machines and adjust the fluid for the best separation conditions.

Currently, many solutions exist in which heat exchange subsea is used to adjust the process fluid using the thermal exchange with seawater. In the current scenario, heat exchange systems are divided into two different types of systems: active and passive.

In a passive subsea heat exchanger, the process fluid passes through tubes in which the heat exchange occurs with the seawater, simply using the principle of thermal conduction. In this case, there is no active form of controlling the thermal exchange.

For the active heat exchangers, the principle of thermal convection is also used to improve and/or control the thermal exchange. The principle of convection is used by controlling the flow of seawater. This control of marine currents can be carried out by increasing the marine flow in the vicinity of the heat exchanger through systems that increase the marine current. Another strategy used for the system is to reduce the marine current, when necessary, to control the temperature of the heat exchanger.

WO 2013/174584 A1 relates to a subsea cooler system for active control of passive coolers. The subsea cooler system comprising at least a first and a second cooler arranged in a series connection, and a third cooler arranged in parallel with said first and second coolers. At least one of said coolers comprises a recirculation loop.

There are however drawbacks related to the prior art solutions above, because all required parameters of the process fluid exiting the cooler system is not known, resulting in a potential risk of damaging any equipment downstream of the cooler system.

One of the objectives of this invention is thus to provide a subsea system which ensures that the process fluid entering a pump or pressure boosting device has fluid characteristics that will not damage the equipment.

SUMMARY OF INVENTION

The invention is set forth in the independent claims, while the dependent claims describe other characteristics of the invention.

Using a passive cooler with a secondary line for controlling the temperature of the process fluid, renders it possible to control the outlet temperature of the process fluid exiting the cooler in a way that the thermal load at the inlet of the cooler can be varied. This control adjusts the process fluid for the overall cooler system's outlet condition without the need to add new rotary equipment and consequently increasing the number of failure points.

The process fluid preconditioning system on the suction, i.e. upstream, of the pressure boosting device aims to guarantee the pressure boosting device operation, maintaining the temperature at the discharge, i.e. upstream, of pressure boosting device and any interstage of this device, in accordance with system requirements in terms of at least density and minimum temperature requirements.

The invention relates to a subsea system connected to a subsea well for boosting a process fluid flowing out of the well, comprising:

- a preconditioning arrangement connectable to a process fluid line from a well, wherein the preconditioning arrangement comprises:
  - at least one sensor for measuring temperature and one sensor for measuring pressure of the process fluid,
  - means for estimating density of the process fluid based on measured temperature and pressure,
  - a cooler system comprising at least a first cooler for cooling the process fluid, wherein the first cooler comprises a bypass line for guiding a portion of the process fluid therethrough and wherein the bypass line comprises a control valve for varying the amount of process fluid flowing therethrough and a temperature control unit for measuring a temperature in the process fluid in the bypass line, wherein the subsea system further comprises:

- a pressure boosting device arranged downstream of the preconditioning arrangement and wherein the pressure boosting device comprises an inlet for receiving a process fluid with at least 30 volume percentage of $CO_2$ at operational subsea conditions and an outlet for discharge of pressurized process fluid, the pressure boosting device having an operational window dictating operational parameter in terms of maximum and minimum allowable density of the process fluid entering the pressure boosting device, and wherein the preconditioning arrangement ensures that the process fluid is within the operational window of the pressure boosting device before entering the pressure boosting device.

The sensors used for measuring temperature and pressure may be standard temperature and pressure sensors used subsea. The sensors may be arranged at the outlet of the cooler(s) or they can be arranged elsewhere in the preconditioning arrangement.

Normally, the composition of the process fluid is known either by taking a sample and or from measurements from e.g. a multiphase meter etc. Although the composition of the process fluid, e.g. water-cut etc., varies with time, the changes on a day-to-day or month-to-month basis is normally insignificant. Thus, it is not common practice to perform real tests of the process fluid composition too often. The means for estimating maximum and minimum allowable density of the process fluid may then be a pre-made diagram for the specific process fluid for this subsea well where density can be read based on the measured temperature and pressure. The maximum and minimum allowable density may be decided based on parameters such as, in addition to temperature, pressure and composition of the process fluid, hydrate formation temperature.

The cooler system provides for thermal exchange between the process fluid and the surrounding seawater and can be of the type described in WO 2013/174584, which content is hereby incorporated in its whole. The system can have two or more stages of thermal exchange. Each of these parameters contemplates cooling tubes, where the heat transfer occurs between the process fluid and the seawater. These coolers can be organized in series and/or in parallel allowing different scenarios and modes of operation to be attended.

The cooler system may comprise one or more coolers. Each cooler may be composed of parallel tubes, forming horizontal sections. The number of horizontal sections and the length of each section is determined in accordance with the value of maximum design thermal load at the inlet of the cooler.

In the design of the preconditioning system, the cooler system/cooling stages can be aligned in series and/or parallel. The design of the cooler system can be such that the different cooling stages have different cooling capacity.

Each or some of the coolers may comprise a bypass line that permits that part of the fluid is diverted from the cooler and allowed to enter the bypass line instead. This deviation is accomplished through the manipulation of the control valve present in this bypass line. The amount of process fluid flowing in the bypass line is determined in order to meet the criteria of specific temperature in the system.

The flow that was deviated from the cooler through the bypass line is preferably mixed with the flow coming from the cooler downstream of the cooler, in which a thermal equilibrium is obtained at the outlet of the cooler. The greater the flow that passes through the bypass line, the higher the equilibrium temperature of the system.

The process fluid is preferably a so-called dense gas, which is a natural gas rich in CO2. This gas has a composition similar to the natural gas produced in Brazilian Pre-Salt well fields, with a high-density value as a differential, similar to fluids in the liquid state. The process fluid comprises at least 30 volume percentage of CO2 at operational subsea conditions, i.e. at the conditions where the pressure boosting device is arranged. Additionally, typical characteristic parameters for the process fluid is in the range of:

density 200 kg/m3 to 700 kg/m3;

30% to 90% of CO2 by volume (volume percentage);

60 bar to 400 bar, and

0° C. to 120° C.

The density or specific mass of the process fluid varies dependent on the pressure and temperature. Simulations carried out with different temperatures for the process fluid verified that if reducing the temperature, the density of the process fluid increases. Specific mass values lower than 260 $kg/m^3$ make it impossible to utilize the pressure boosting device, in which fluid preconditioning is necessary, reducing the temperature in a controlled manner, reaching the value of specific mass that permits operation of the pressure boosting device.

In addition to dictating operational parameter in terms of maximum and minimum allowable density, the operational window may have at least maximum and minimum operational parameters of pressure and temperature.

This system may be arranged downstream a separation device. The process fluid flowing through the subsea system may be re-injected into a reservoir. Therefore, another determining factor for the parameters of this system may be the temperature limit in the injection lines used to inject the process fluid discharged from the pressure boosting device. In certain operating modes, the temperature at the discharge of the pressure boosting will change, requiring a fluid preconditioning system at its suction, adjusting the temperature of the discharge. The preconditioning arrangement of the subsea system will enable the operation of the pressure boosting device, in addition to keeping the required temperature allowed by the injection line.

The bypass lines containing their respective control valves, can be added to allow for an active temperature control at the outlet of each cooler stage of the preconditioning system.

When the demand for thermal load required by the process fluid is reduced, it is necessary to manipulate the bypass line control valve. Then a larger portion of the process fluid is guided or deviated through the bypass line resulting in less decrease in temperature (compared to guiding all process fluid through the cooler) and thus less increase in the density of the process fluid (compared to guiding all process fluid through the cooler resulting in an even lower temperature). In this way, if operating on the limit of the minimum acceptable density for the process fluid, the required specific mass value is obtained such that the process fluid can enter the pressure boosting device.

The proposed active temperature control system, besides guaranteeing the specific mass or density required in the system output, also acts in the prevention of hydrate at each cooler. The prevention of hydrate formation in the cooler(s), may be achieved using a temperature controller that manipulate the recirculation line of the pressure boosting device.

The active control described above, can be applied in natural and/or forced convection heat transfer process. This control linked to the diverse possibilities of stage arrangements, guaranties the possibility of the preconditioning system attending a large variety of work temperature at any point of the system.

The system is designed to attend the process fluid's maximum thermal load. In this condition, i.e. at maximum thermal load, 100% of the flow will pass through the coolers by the main line and the control valves of the bypass lines will be closed.

This invention enables the subsea dense gas pressurization system and the subsequent re-injection of the process fluid into a reservoir.

The system can be installed at a depth of up to 3,000 meters.

The main cooler inlet line may be specified in order to attend a uniform distribution between all tubes connected to it. This configuration enables uniform distribution between all the parallel process fluid tubes entering into the cooler, without causing preferential flow.

The main cooler outlet line may be specified in order to attend a uniform distribution between all tubes connected to it. This configuration enables uniform distribution between all the parallel process fluid tubes that exit the cooler, resulting in a uniform mixture of the process fluid entering the pressure boosting device.

An additional control valve or restriction orifice may be positioned in the suction, i.e. upstream, or discharge, i.e. downstream, of the cooler, performing the pressure equalization.

The subsea system may comprise a recirculation loop connected downstream of the pressure boosting device and upstream of the preconditioning arrangement. The recirculation loop may comprise a pump recirculation valve which is connected to a temperature transmitter measuring temperature of the process fluid downstream of the first cooler. The pump recirculation valve may be controlled by the temperature transmitter downstream of the first cooler. If the temperature of the process fluid downstream of the first cooler is low (e.g. due to reduced flow from the well) with the risk of hydrate formation in the cooler(s), the pump recirculation valve opens thereby recirculating process fluid which has been pressurized by the pressure boosting device into the preconditioning arrangement. As such, the risk of hydrate formation resulting from reduced flow, and thereby reduced temperature of the process fluid exiting the first cooler, is reduced. I.e. the recirculation loop may be necessary if the process fluid has not reached satisfying temperature at the outlet of the first cooler.

In an aspect, the cooler system comprises a second cooler arranged in series or parallel connection with the first cooler. The second cooler may have equal, higher or lower cooling capacity than the first cooler.

In an aspect, the cooler system comprises a third cooler which is arranged in parallel connection with the first and second cooler. If the first and second coolers are arranged in series, and the third cooler in parallel, there is a total of two cooling branches, whereas if the first, second and third coolers are in parallel connection, there is a total of three cooling branches. The different cooling branches preferably have different cooling capacity such that different cooling requirements or cooling demands may be met without modifying the system.

The cooler system may comprise at least one flow control device, e.g. a valve, for directing flow through at least one of the cooling branches dependent on the cooling requirement.

In an aspect, some or all the coolers may comprise a recirculation loop for recirculating process fluid back into an inlet of the cooler.

In an aspect, some or all the coolers may comprise a chemical injection line. The preconditioning system presents the possibility of inserting a chemical injection point at the inlet of each cooling stage. The point of injection allows for the complete distribution of chemicals added to all the cooler's tubes. The chemical injection fluid can be Mono Ethylene Glycol (MEG) and this chemical injection fluid can be injected into the cooler if there is a risk that hydrates may form in the cooler, e.g. in the tubes forming the cooler. Each of the coolers may have a chemical injection line to prevent the formation of hydrates in operation and for preservation with no flow.

The subsea system may include an active control system of the temperature, complementary to the arrangement of the cooler stages. This control system makes it possible to obtain the specific mass required at the outlet of the preconditioning arrangement in addition to potentially prevent hydrate formation. This control system utilizes subsea temperature transmitters for monitoring temperatures in real time.

The invention also relates to a method of operating a subsea system, the subsea system comprising:

- a pressure boosting device comprising an inlet for receiving a process fluid with at least 30 volume percentage of CO2 at operational subsea conditions and an outlet for discharge of pressurized process fluid, the pressure boosting device having an operational window dictating operational parameter in terms of maximum and minimum allowable density of the process fluid entering the pressure boosting device;
- a preconditioning arrangement for handling the process fluid, wherein the preconditioning arrangement is arranged upstream of the inlet of the pressure boosting device, and wherein the preconditioning arrangement is connectable to a process fluid line from a well and wherein the preconditioning arrangement comprises:
  - one sensor for measuring temperature and one sensor for measuring pressure of the process fluid,
  - a cooler system comprising at least a first cooler, and wherein the method comprises the steps of:
    - measuring parameters of the process fluid entering the preconditioning arrangement using the sensors;
    - determine whether any of the parameters are outside an operational window of the pressure boosting device;
    - decide whether any action is required by the preconditioning arrangement in order for the density of the process fluid to be within the operational window of the pressure boosting device, and
    - when any required actions are taken in order for the density of the process fluid to be within the operational window of the pressure boosting device, allowing the process fluid to enter the pressure boosting device thereby ensuring that the process fluid is within the operational window of the pressure boosting device before entering the pressure boosting device.

The operational parameters which is measured and estimated in the method, may be density pressure and/or temperature and is dictated by the operational window of the pressure boosting device.

The system uses an active control of the temperature, complementary to the arrangement of the cooling stages. This control makes it possible to obtain the specific mass required at the outlet of the system, and the prevention of hydrate formation.

This control system utilizes subsea temperature transmitters for monitoring temperatures in real time.

Summarized, the subsea system and method may have at least one of the following advantages:

- New rotary equipment and consequently increasing the number of failure points is avoided.
- The process fluid preconditioning system on the suction of the pressure boosting device aims to guarantee its operation, maintaining the temperature at the discharge of the pressure boosting device adequate to the system requirements,
- Preconditioning the process fluid on the suction of the pressure boosting device enables its operation, in the operational modes where the fluid temperature increases and in normal operation, where the reservoir fluid does not have adequate specific mass for the operation of this pressure boosting device.

These and other embodiments of the present invention will be apparent from the attached drawings, where:

DETAILED DESCRIPTION OF A PREFERENTIAL FORM OF EMBODIMENT

Figure 1A:
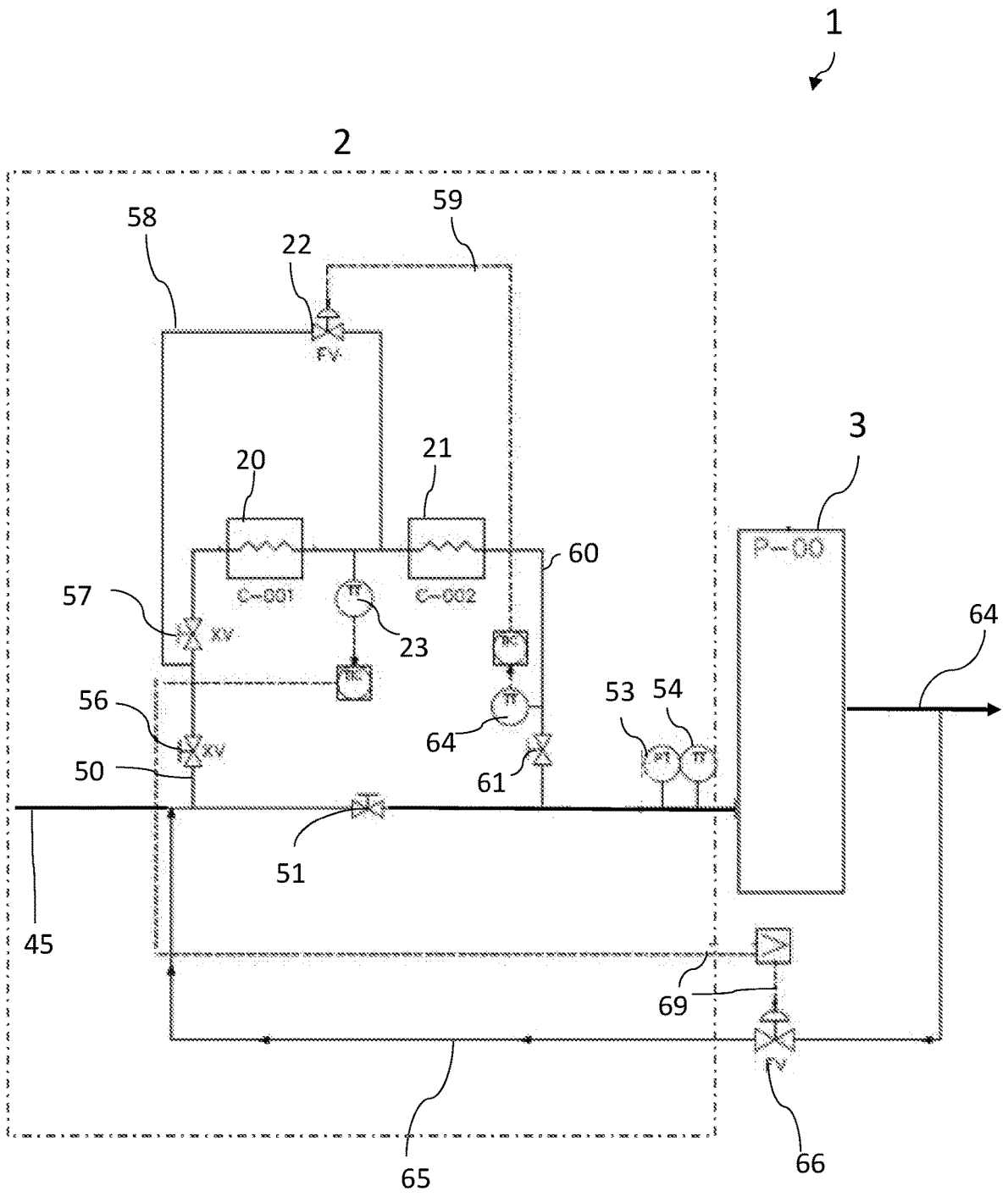
FIG. 1A is a setup of a subsea system according to the invention.

In the following, embodiments of the invention will be discussed in more detail with reference to the appended drawings. It should be understood, however, that the drawings are not intended to limit the invention to the subject-matter depicted in the drawings.

FIG. 1A is a setup of a subsea system 1 according to the invention. The subsea system 1 as disclosed in FIG. 1 comprises a preconditioning arrangement 2 and a pressure boosting device 3. The pressure boosting device 3 has an operational window dictating operational parameters in terms of maximum and minimum allowable density of the process fluid entering the pressure boosting device, and the preconditioning arrangement ensures that the process fluid is within the operational window of the pressure boosting device before entering the pressure boosting device 3. Other operational parameters such as temperature, pressure and flow of the pressure boosting device may also be limiting factors relevant for the operational window. The preconditioning arrangement 2 ensures that the process fluid entering the pressure boosting device 3 is within the operational window for the pressure boosting device 3 such so that the pressure boosting device is not damaged by the process fluid.

In operation, process fluid from e.g. a well (not shown in FIG. 1A) enters the preconditioning arrangement 2 of the subsea system 1 via an inlet pipe or process fluid pipe or main line 45. In the preconditioning arrangement 2 the main line 45 includes an on-off valve 51 to direct the fluid into a branch line 50. The branch line 50 comprises a first on-off valve 56 and a second on-off valve 57 arranged in series. A first cooler 20 is arranged downstream of the second on-off valve 57 and a second cooler 21 is arranged downstream of the first cooler 20. A temperature transmitter 23 controls the temperature of the process fluid after exiting the first cooler 20. The temperature transmitter 23 is connected via control lines 69 to a controller controlling a pump recirculation valve 66 arranged in a recirculation line 65 connected downstream of the pressure boosting device 3. In case of risk of hydrate formation, the controller manipulates the pump recirculation valve 66 to guarantee a minimum temperature by opening the pump recirculation valve 66, as will discussed in greater detail below. A first bypass line 58 is connected between the first and second on-off valves 56, 57 at one end thereof and between the first and second coolers at the other end thereof, thereby bypassing the first cooler 20. The bypass line 58 comprises an operated control valve 22 for guiding the flow in the bypass line 58 to the second cooler 21. The control valve 22 uses a temperature transmitter 70 to control the temperature of the process fluid in the pressure boosting device 3. An on-off valve 61 is arranged in the outlet line 60 of the second cooler 21. The outlet line 60 is connected to the main line 45 downstream of the on-off valve 51 in the main line 45 and upstream of the pressure boosting device 3.

The recirculation line 65 is connected to an outlet line 64 downstream of the pressure boosting device 3 and the main line 45. The pump recirculation valve 66 is arranged in the recirculation line 65 to control minimum flow of the boosting device 3 and minimum temperature in the preconditioning arrangement 2. The pump recirculation valve 66 is connected via control lines 69 to temperature transmitter 23 measuring the temperature of the process fluid downstream of the first cooler 20. The pump recirculation valve 66 is controlled by the temperature transmitter 23. If the temperature of the process fluid downstream of the first cooler 20 is low (e.g. due to reduced flow from the well) with the risk of hydrate formation in the cooler(s) 20, 21, the pump recirculation valve 66 opens to thereby recirculate process fluid which has been pressurized by the pressure boosting device 3 into the preconditioning arrangement 2. As such, the risk of hydrate formation resulting from reduced flow, and thereby reduced temperature of the process fluid exiting the first cooler, is reduced. I.e. the recirculation loop 65 may be necessary if the process fluid has not reached satisfying temperature at the outlet of the first cooler 20.

Figure 1B:
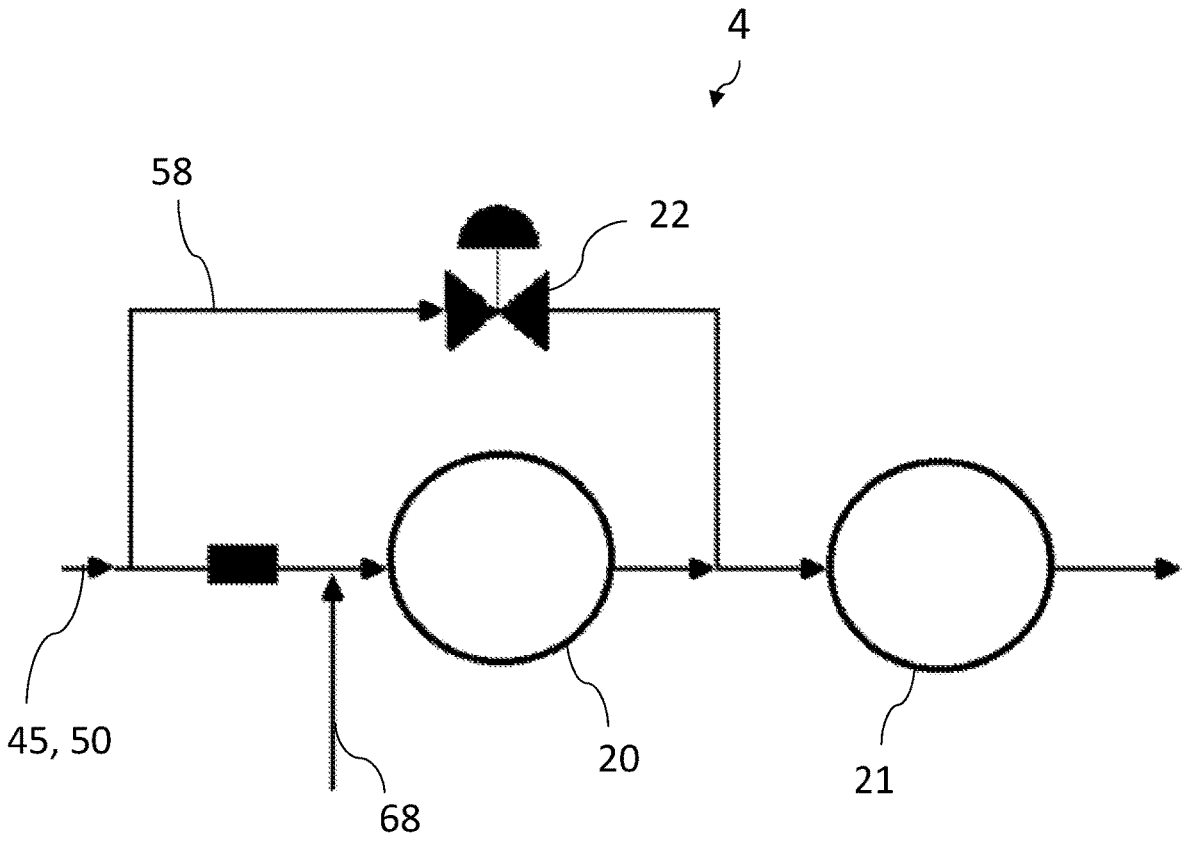
FIG. 1B is an example of a cooler system forming part of the subsea system.

FIG. 1B is an example of a cooler system 4 forming part of the subsea system. The cooler system 4 comprises a connection to the process fluid line 45 or the branch line 50 as disclosed in the subsea system 1 in FIG. 1A. In the cooler system 4 of FIG. 1B the first and second coolers 20, 21 are arranged in series and a passive cooler system is actively controlled by the pneumatically operated valve 22 which can be adjusted in order to adjust the amount of process fluid flowing through the bypass line 58.

The operational conditions of the disclosed cooler system in terms of cooling capacity are as follows:

1) operated valve 22 closed: all process fluid flows through first and second coolers 20, 21=maximum cooling capacity,
2) operated valve 22 fully open and on-off valve 57 closed: all process fluid flows through the bypass line 58 and into the second cooler 21 only=minimum cooling capacity,
3) operated valve 22 partly open: some process fluid flows through the bypass line 58=medium cooling capacity.

The amount of process fluid is thus dependent on the active control of the operated valve 22 and the amount of process fluid which flows through the bypass line 58.

A chemical injection line 68 is connected to the process fluid line 45 upstream of the first cooler 20. Alternatively, the chemical injection line 68 could be connected downstream of the first cooler 20 but upstream of the second cooler 21.

Fluid exiting the second cooler 21 is typically directed to or towards the pressure boosting device 3 (as shown in FIG. 1A).

Figure 2A:
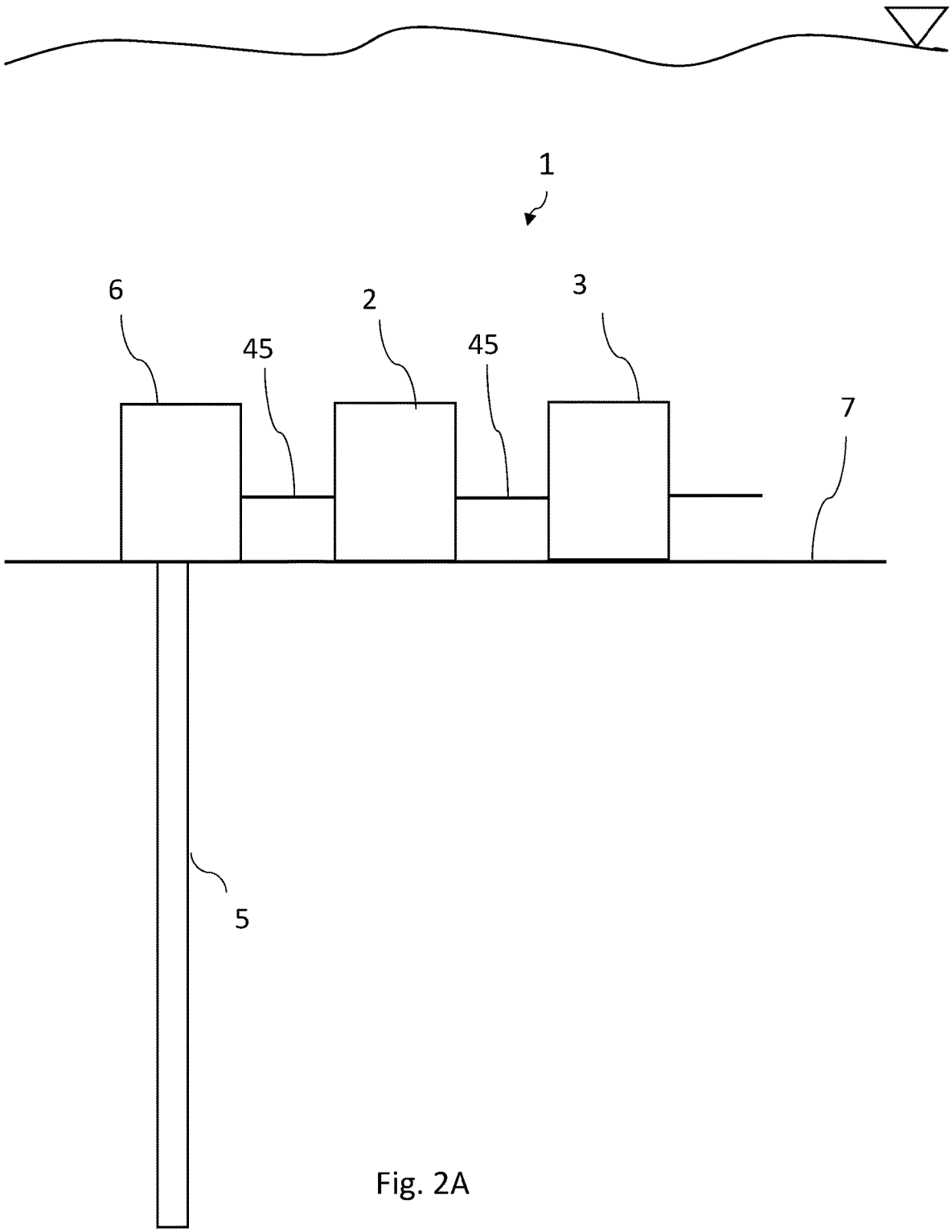
FIG. 2A is an example of a subsea system connected to a well, wherein the subsea system comprises a subsea tree, a preconditioning arrangement and a pressure boosting device.

FIG. 2A is an example of a subsea system 1 connected to a well 5, where the subsea system 1 is arranged on a seabed 7 and comprises a subsea tree 6, a preconditioning arrangement 2 and a pressure boosting device 3. The components of the subsea system 1 are fluidly connected to each other via a process fluid line/main line 45.

Figure 2B:
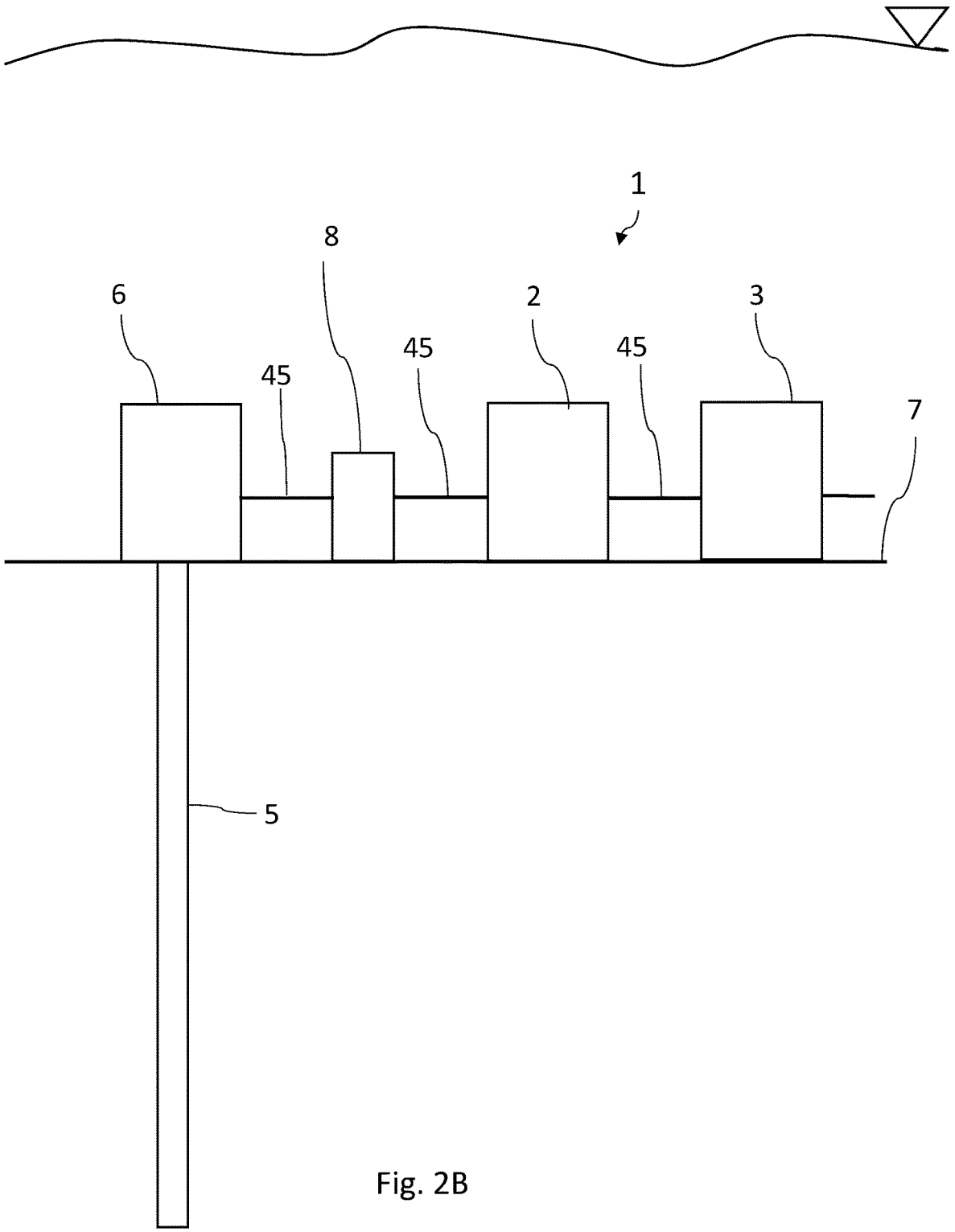
FIG. 2B is an example of a subsea system connected to a well, wherein the subsea system comprises a subsea tree, a separation device, a preconditioning arrangement and a pressure boosting device.

FIG. 2B is an example of a subsea system 1 connected to a well 5, wherein the subsea system 1 is arranged on a seabed 7 and comprises a subsea tree 6, a separation device 8, a preconditioning arrangement 2 and a pressure boosting device 3. The separation device 8 serves to separate the process fluid before entering the preconditioning arrangement 2. The components of the subsea system 1 are fluidly connected to each other via a process fluid line/main line 45.

Figure 3A:
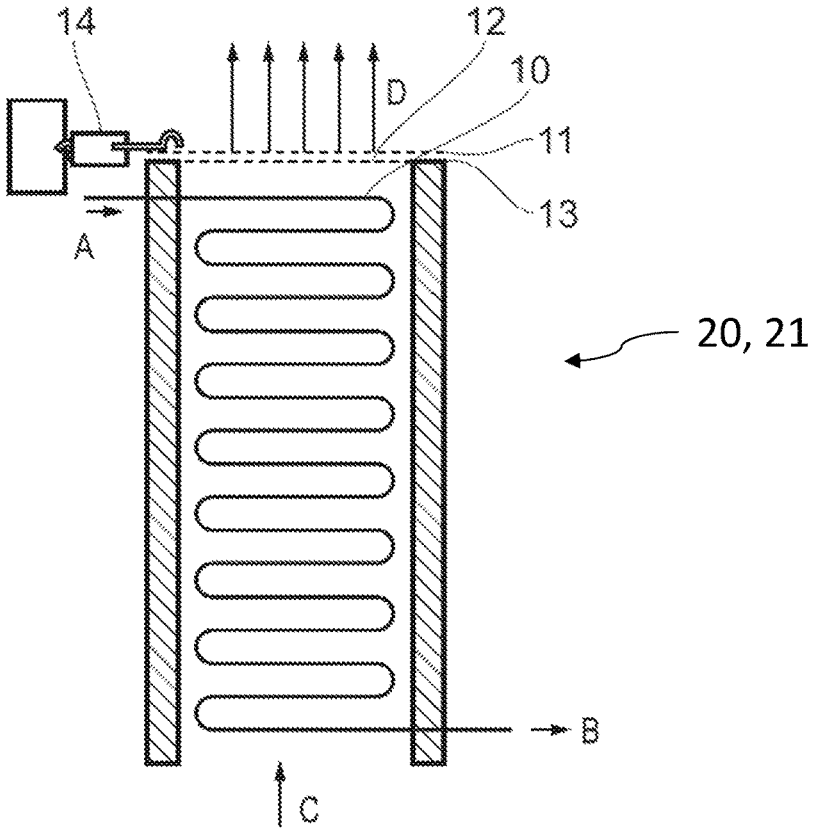
FIG. 3A shows a side-view of a cooler which can form part of the subsea system.

FIG. 3A shows an example of a single cooler. In the exemplified cooler, the cooler is arranged in a subsea environment. The well flow, i.e. process fluid flow, enters the cooler coil 10 in the upper part. The inflow direction is shown by arrow A. The well flow exits the cooler in a lower part. The outflow direction out of the coil 10 in the cooler is shown by arrow B. Preferably, seawater enters from beneath the cooler (shown by arrow C in the figure) and escapes through the upper part of the cooler, shown by arrow D. On the upper end of the cooler is arranged a first perforated plate 11 and a second perforated plate 13, both with perforations 12. The second perforated plate 13 is connected to the walls of the cooler. The first perforated plate 11 is movable and arranged in a parallel plane relative the second perforated plate 13. The movement of the first perforated plate 11 is for example conducted by means of an actuator 14, which actuator 14 is typically of a mechanical, electrical type etc. By arranging the first perforated 11 plate movable relatively the second perforated plate 13, it is possible to adjust the flow of seawater through the cooler, as the cooling of the well flow is driven by natural convection. The well flow, having a high temperature, enters the coil 10 in the cooler at arrow A and is heat-exchanged with seawater that has already been heated by the well flow in the lower part of the cooler. Therefore, the well flow experiences a graduated cooling, i.e. first it is exposed to heated seawater, then it is exposed to cold seawater. The heated seawater will move within the cooler, in this case it rises. Due to the convection, the heated seawater travels to a relatively colder area.

Figure 3B:
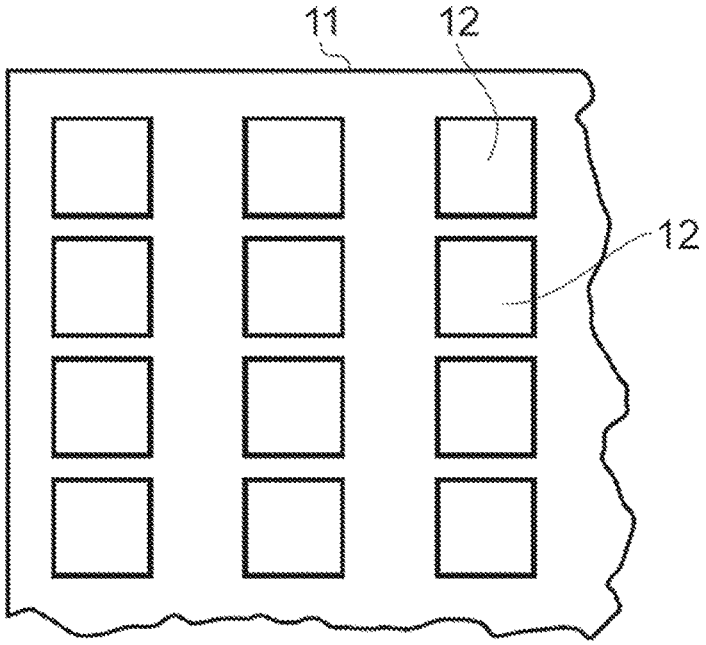
FIG. 3B shows a top view of a perforated plate of a single cooler.

FIG. 3B shows a top view of an example of the configuration of the first perforated plate 11 being provided with perforations 12. A movement of the first perforated plate 11 relative the second perforated plate 13, controls the flow area through the perforations of the first and second perforated plates, i.e. the convective flow rate, of seawater flowing through the cooler.

Figure 4:
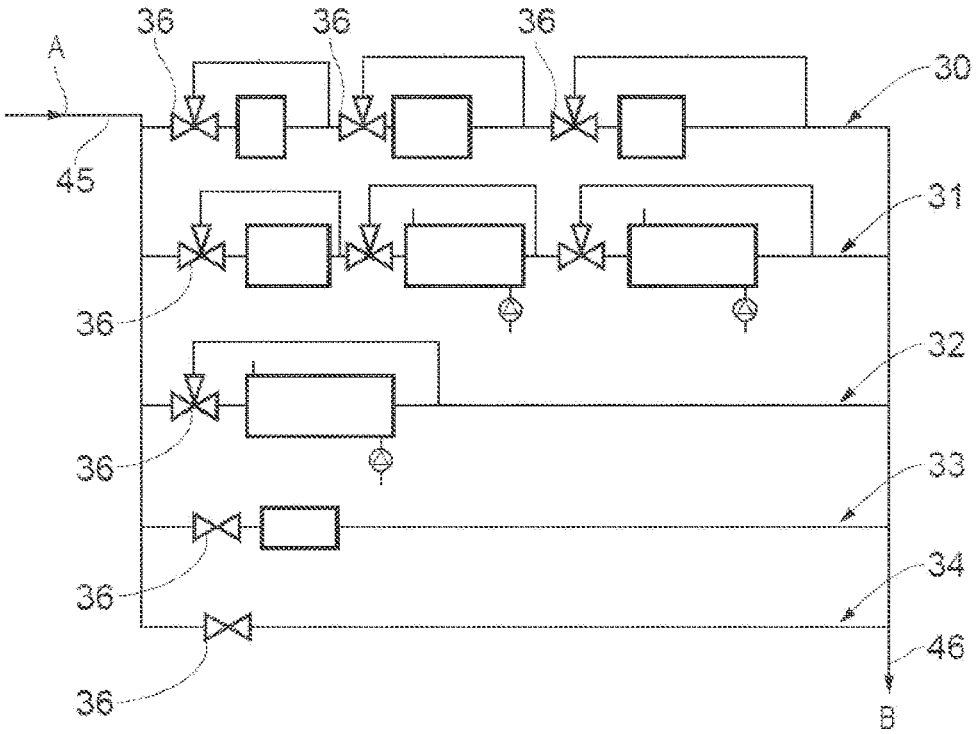
FIG. 4 shows a cooler system as illustrated in FIG. 4 in WO 2013/174584 comprising five parallel cooler series, where some of the coolers are provided with a recirculation loop.

FIG. 4 shows an example of a cooling system which may be used with the invention, and in particular shows the cooler system as disclosed in FIG. 4 in WO 2013/174584. The well flow enters the cooler system through inlet pipe 45. The flow direction is shown by arrow A. The flow exits the cooler system through outlet pipe 46. The flow direction is shown by arrow B. In the figure five branches 30, 31, 32, 33, 34 are shown, where the branches are all arranged in parallel with each other. At the inlet of each branch 30, 31, 32, 33, 34 it is arranged a flow control device 36 controlling the inflow into each branch, and into each cooler. The flow control device 36 is typically a three-way valve or other means capable of directing a well flow. Additionally, sensors such as temperature sensors, flow sensors and/or pressure sensors may be used. The sensors can be arranged at different positions in the cooler system, e.g. one at each cooler, between the coolers, at the inlet of a cooler series or branch, etc. Dependent on required cooling capacity, the flow control means 36, arranged at each inlet of a branch, may direct the flow into one or more of the different branches. In the exemplified embodiment, branch 31 is the cooling series that has the largest cooling capacity of the shown branches, while branch 33 has the lowest cooling capacity if excluding branch 34. Branch 34 is a bypass line, allowing the flow to flow through the cooler system bypassing all the coolers.

Figure 5:
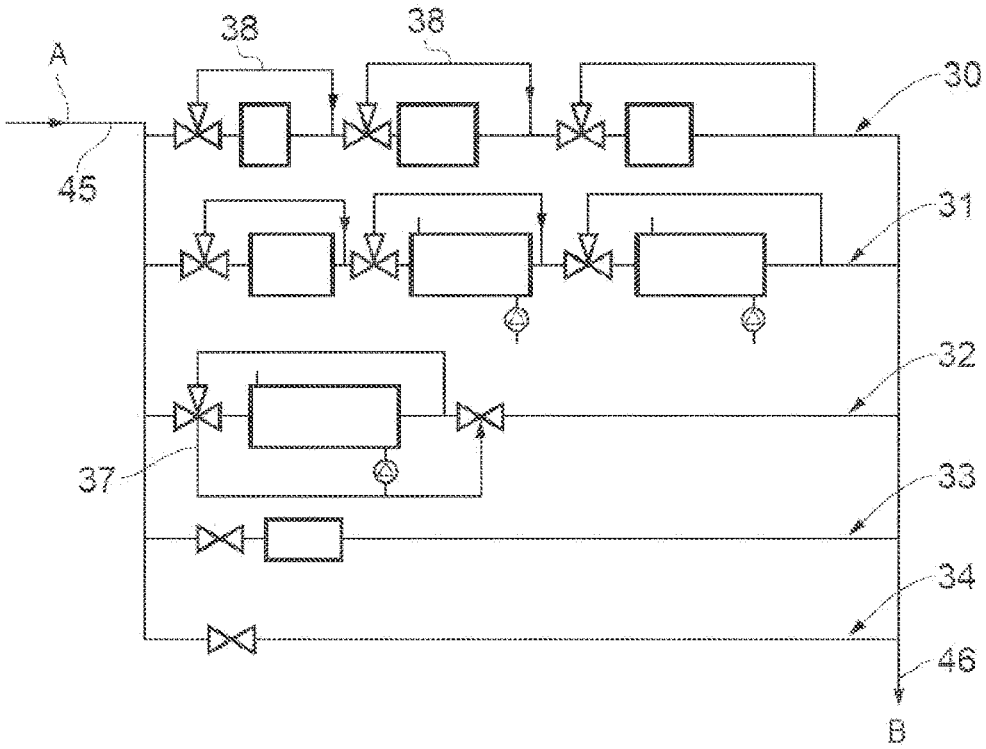
FIG. 5 shows a cooler system as illustrated in FIG. 5 in WO 2013/174584, where some of the coolers are provided with a recirculation loop and a bypass loop.

FIG. 5 shows a cooler system which may be used with the subsea system, and in particular shows the cooler system as disclosed in FIG. 5 in WO 2013/174584. In connection with each cooler, a bypass circuit 37, 38 may be arranged for bypassing at least parts of a fluid flow if, for instance, the temperature is above a threshold value. The bypass circuit 37, 38 may be of the form of a one-way flow loop as disclosed by reference numeral 37 or a two-way flow loop as shown by reference numeral 38. The system may in addition include all the features of the embodiment disclosed in FIG. 4.

The cooler system provides large flexibility with regards to the cooling requirement. Being able to provide a cooler system having different cooling capacities dependent on the cooling need, is advantageous bearing in mind that the hydrate formation temperature and/or flow rates may vary during the lifetime of a field.

The invention is now explained with reference to non-limiting embodiments. However, a skilled person will understand that there may be made alterations and modifications to the embodiment that are within the scope of the invention as defined in the attached claims.

LIST OF REFERENCES

| | |
|---|---|
| 1 | Subsea system |
| 2 | Preconditioning arrangement |
| 3 | Pressure boosting device |
| 4 | Cooler system |
| 5 | well |
| 6 | Subsea tree |
| 7 | Seabed |
| 8 | Separation device |
| 10 | Cooler coil |
| 11 | First perforated plate |
| 12 | perforations |
| 13 | Second perforated plate |
| 14 | actuator |
| 20 | First cooler |
| 21 | Second cooler |
| 22 | operated valve/on-off valve |
| 23 | Temperature transmitter |
| 24 | Second bypass line |
| 30, 31, 32, 33, 34 | branches |
| 36 | Flow control device |
| 37, 38 | Bypass circuit |
| 45 | Inlet pipe/process fluid line/main line |
| 46 | Outlet pipe |
| 50 | Branch line |
| 51 | Pressure control valve (main line)/on-off valve |
| 53 | Pressure transmitter (main line) |
| 54 | Temperature transmitter (main line) |
| 55 | Flow transmitter |
| 56 | First pressure control valve (branch line)/on-off valve |
| 57 | Second pressure control valve (branch line)/on-off valve |
| 58 | First bypass line |
| 59 | Second bypass line |

-continued

| | |
|---|---|
| 60 | Outlet line |
| 61 | Pressure control valve (outlet line)/on-off valve |
| 63 | Check valve |
| 64 | Outlet line (pressure boosting device) |
| 65 | Recirculation line |
| 66 | pump recirculation valve |
| 68 | Chemical injection line |
| 69 | Control lines |
| A, B, C, D | Direction of flow |

The invention claimed is:

1. A subsea system for boosting a process fluid from a subsea well, the subsea system comprising:

a pressure boosting device;

a preconditioning arrangement arranged upstream of the pressure boosting device, the preconditioning arrangement comprising:

a main line having a first end connectable to the subsea well and a second end connected to an inlet of the pressure boosting device;

a branch line having a first end connected to the main line at a first point and a second end connected to the main line at a second point located downstream of the first point;

a first valve arranged in the main line for selectively directing the process fluid through the main line or into the upstream end of the branch line;

a cooler system comprising:

a first cooler arranged in the branch line for cooling the process fluid;

a bypass line having a first end connected to the branch line upstream of the first cooler and a second end connected to the branch line downstream of the first cooler; and a second valve arranged in the bypass line for controlling the flow of process fluid through the bypass line;

wherein the first and second valves are controllable to control the flow of process fluid through the cooler system to selectively cool the process fluid and thereby ensure that the process fluid is within an operational window of the pressure boosting device prior to entering the pressure boosting device.

2. The subsea system according to claim 1, further comprising:

a recirculation line having a first end connected downstream of the pressure boosting device and second end connected to the main line upstream of the inlet end of the branch line;

a third valve arranged in the recirculation line; and a temperature transmitter arranged in the branch line to measure a temperature of the process fluid in the branch line;

wherein the third valve is controlled based on the temperature measured by the temperature transmitter.

3. The subsea system according to claim 1, wherein the cooler system comprises a second cooler arranged in the branch line in series with and downstream of the first cooler, and wherein the second end of the bypass line is connected to the branch line between the first and second coolers.

4. The subsea system according to claim 3, wherein the preconditioning arrangement comprises a fourth valve arranged in the branch line upstream of the first cooler, and wherein the first end of the bypass line is connected to the branch line upstream of the second valve.

5. The subsea system according to claim 1, wherein the preconditioning arrangement comprises a fourth valve arranged in the branch line upstream of the first cooler, and wherein the first end of the bypass line is connected to the branch line upstream of the second valve.

6. A subsea system connected to a subsea well for boosting a process fluid flowing out of the well, the subsea system comprising:

a pressure boosting device comprising an inlet for receiving a process fluid with at least 30 volume percentage of CO2 at operational subsea conditions and an outlet for discharge of pressurized process fluid, the pressure boosting device having an operational window dictating operational parameters in terms of maximum and minimum allowable density of the process fluid entering the pressure boosting device;

a preconditioning arrangement arranged upstream of the pressure boosting device, the preconditioning arrangement comprising:

a main line having a first end connectable to the well and a second end connected to the inlet of the pressure boosting device;

a branch line having an upstream end connected to the main line at a first point and a downstream end connected to the main line at a second point located downstream of the first point;

a first valve arranged in the main line for selectively directing the process fluid through the main line or into the upstream end of the branch line;

at least one sensor for measuring a temperature of the process fluid and at least one sensor for measuring a pressure of the process fluid; and a cooler system comprising at least a first cooler arranged in the branch line for cooling the process fluid, a bypass line having a first end connected to the branch line upstream of the first cooler and a second end connected to the branch line downstream of the first cooler, a control valve arranged in the bypass line for varying the amount of process fluid flowing through the bypass line, and a temperature transmitter for measuring a temperature of the process fluid in the bypass line;

wherein the preconditioning arrangement is configured to selectively cool the process fluid to thereby maintain the density of the process fluid within the operational window of the pressure boosting device before entering the pressure boosting device.

7. The subsea system according to claim 6, wherein the operational window has at least maximum and minimum operational parameters of the pressure and temperature of the process fluid.

8. The subsea system according to claim 6, further comprising a recirculation loop having a first end connected downstream of the pressure boosting device and a second end connected to the main line upstream of the upstream end of the branch line.

9. The subsea system according to claim 6, wherein the cooler system comprises a second cooler arranged in the branch line in series or parallel with the first cooler.

10. The subsea system according to claim 9, wherein the cooler system comprises a third cooler arranged in the branch line in parallel with the first and second coolers.

11. The subsea system according to claim 9, wherein the cooler system comprises at least one flow control device for directing flow through at least one of the first and second coolers.

12. The subsea system according to claim 9, wherein at least one of the first and second coolers comprises a recirculation loop for recirculating process fluid back into an inlet of the cooler.

13. The subsea system according to claim 9, wherein the first and second coolers have a different cooling capacity.

14. The subsea system according to claim 9, wherein the first cooler comprises a chemical injection line.

15. The subsea system according to claim 6, further comprising a recirculation loop having a first end connected downstream of the pressure boosting device and a second end connected to the main line upstream of the upstream end of the branch line, wherein the recirculation loop comprises a pump recirculation valve which is connected to the temperature transmitter, wherein the temperature transmitter is arranged to measure the temperature of the process fluid downstream of the first cooler, and wherein the pump recirculation valve is controlled by the temperature transmitter.

16. The subsea system according to claim 6, wherein the preconditioning arrangement comprises a second valve arranged in the branch line upstream of the first cooler, and wherein the first end of the bypass line is connected to the branch line upstream of the second valve.

17. The subsea system according to claim 6, wherein the cooler system comprises a second cooler arranged in the branch line in series with and downstream of the first cooler, and wherein the second end of the bypass line is connected to the branch line between the first and second coolers.

18. A method of operating a subsea system, the subsea system comprising:

a pressure boosting device comprising an inlet for receiving a process fluid with at least 30 volume percentage of CO2 at operational subsea conditions and an outlet for discharge of pressurized process fluid, the pressure boosting device having an operational window dictating operational parameters in terms of a maximum and minimum allowable density of the process fluid entering the pressure boosting device;

a preconditioning arrangement positioned upstream of the inlet of the pressure boosting device, the preconditioning arrangement comprising:

a main line having a first end connectable to the subsea well and a second end connected to the inlet of the pressure boosting device;

a branch line having an upstream end connected to the main line at a first point and a downstream end connected to the main line at a second point located downstream of the first point;

a first valve arranged in the main line for selectively directing the process fluid through the main line or into the upstream end of the branch line;

at least one first sensor for measuring a temperature of the process fluid and at least one second sensor for measuring a pressure of the process fluid; and a cooler system comprising at least a first cooler arranged in the branch line, a bypass line having a first end connected to the branch line upstream of the first cooler and a second end connected to the branch line downstream of the first cooler, and a control valve arranged in the bypass line for varying the amount of process fluid flowing through the bypass line; wherein the method comprises the steps of:

measuring parameters of the process fluid entering the preconditioning arrangement using the first and second sensors;

determining whether the density of the process fluid is outside the operational window of the pressure boosting device;

determining whether any action is required by the preconditioning arrangement in order for the density of the process fluid to be within the operational window of the pressure boosting device; and after any required actions are taken in order for the density of the process fluid to be within the operational window of the pressure boosting device, allowing the process fluid to enter the pressure boosting device, thereby ensuring that the process fluid is within the operational window of the pressure boosting device before entering the pressure boosting device.

* * * * *